United States Patent [19]

Schumann et al.

[11] 4,180,697

[45] Dec. 25, 1979

[54] VACUUM OVEN WITH GRAPHITE HEATING

[75] Inventors: Erwin Schumann, Bruchkobel; Oskar Bohländer, Grosskrotzenburg, both of Fed. Rep. of Germany

[73] Assignee: Deutsche Gold- and Silber-Scheideanstalt Vormals Roessler, Frankfurt, Fed. Rep. of Germany

[21] Appl. No.: 841,582

[22] Filed: Oct. 12, 1977

[30] Foreign Application Priority Data

Oct. 16, 1976 [DE] Fed. Rep. of Germany ..... 2646890

[51] Int. Cl.[2] ..... H05B 3/10

[52] U.S. Cl. ..... 13/25

[58] Field of Search ..... 13/20, 22, 25; 339/93 R; 338/208, 212, 295

[56] References Cited

U.S. PATENT DOCUMENTS

| | | | |
|---|---|---|---|
| 3,120,597 | 2/1964 | Maloof et al. | 13/25 X |
| 3,257,492 | 6/1966 | Westeren | 13/25 X |
| 4,055,723 | 10/1977 | Vanderford | 13/25 |

FOREIGN PATENT DOCUMENTS

| | | | |
|---|---|---|---|
| 2064961 | 11/1969 | Fed. Rep. of Germany | 13/25 |

*Primary Examiner*—Roy N. Envall, Jr.

*Attorney, Agent, or Firm*—Cushman, Darby & Cushman

[57] ABSTRACT

There is provided a vacuum furnace with graphite heating consisting essentially of the furnace body and heating elements wherein the heating elements are made of flexible thin graphite sheets having a thickness of 0.5–3 mm.

6 Claims, 3 Drawing Figures

VACUUM OVEN WITH GRAPHITE HEATING

BACKGROUND OF THE INVENTION

The invention is directed to a vacuum furnace for the heat treatment of steel, particularly for reduced pressure coking with a graphite heater.

Vacuum furnaces with graphite heaters such as are required for the heat treatment of steels are generally equipped with heating elements made of graphite rods, graphite tubes or of graphite cloth.

Graphite rods or tubes, i.e., heating elements made of solid graphite, have the disadvantage that they have a relatively small resistance. Therefore, there must be provided a long current path, frequently under great difficulties of construction in order to obtain the necessary resistance. Furthermore, the material introduced with the solid graphite is very large and therewith the thermal capacity also is very large, which in turn makes the furnance sluggish in the heating and cooling. A further disadvantage of solid graphite heating elements is the relatively small heating surface which is provided at a specified power so that there cannot be attained a large surface heating.

These disadvantages of solid graphite heating are avoided through the graphite cloth heating. This heating with a graphite fibrous tissue is distinguished above all else by a relatively large resistance, since it is very thin. It has a very small heat capacity and if offers a large heating surface. These clear advantages of graphite cloth, however, are opposed by disadvantages which in certain cases exclude their use as heating elements. In many cases there is incorporated in the vacuum furnace a gas circulator in order that after the thermal treatment is carried out the batch and furnace can be cooled down in accelerated manner under inert gas. For these cases the graphite cloth heating element is not suited because of its low mechanical strength since the cloth is easily damaged by the flow of gas.

A still greater problem is present if a graphite cloth heater is used in furnaces which also are used for reduced pressure coking.

In these processes there is formed atomic carbon by the destruction of the coking gas which carbon also deposits on the heater cloth. Since the cloth is relatively thin, the enrichment with carbon in a short time causes a strong change in the resistance characteristics of the cloth through which the resistance sinks so far that the necessary furnace output can no longer be attained because of the always present limitation on the current. Besides the cloth loses its flexible character and becomes brittle.

Therefore, it was the problem of the present invention to provide a graphite heater for vacuum furnaces which makes possible a large heating surface, has a small heat capacity, whose resistance characteristics are not substantially changed by depositing carbon and which is mechanically stable.

SUMMARY OF THE INVENTION

This problem was solved according to the invention by using heater elements which consist of flexible thin graphite sheets having a thickness of 0.5–3 mm. For heater elements particularly resistant mechanically it is recommended to use sheet materials having a thickness of about 1.5 to 2 mm. Heating elements having this wall thickness are resistant to the action of the flow of gas and insusceptible to deposition of carbon in the reduced pressure (vacuum) coking since the deposited carbon layer is very small in comparison to wall thickness of the element present. On the other hand the heating elements of the invention are very low in capacity compared to solid graphite. Long current passages can be attained easily through corresponding cutting of the sheets. The furnace can comprise, consist essentially of or consist of the elements set forth.

BRIEF DESCRIPTION OF THE DRAWINGS

The invention will be understood best in connection with the drawings, wherein.

DESCRIPTION OF THE PREFERRED EMBODIMENTS

Figure 1:
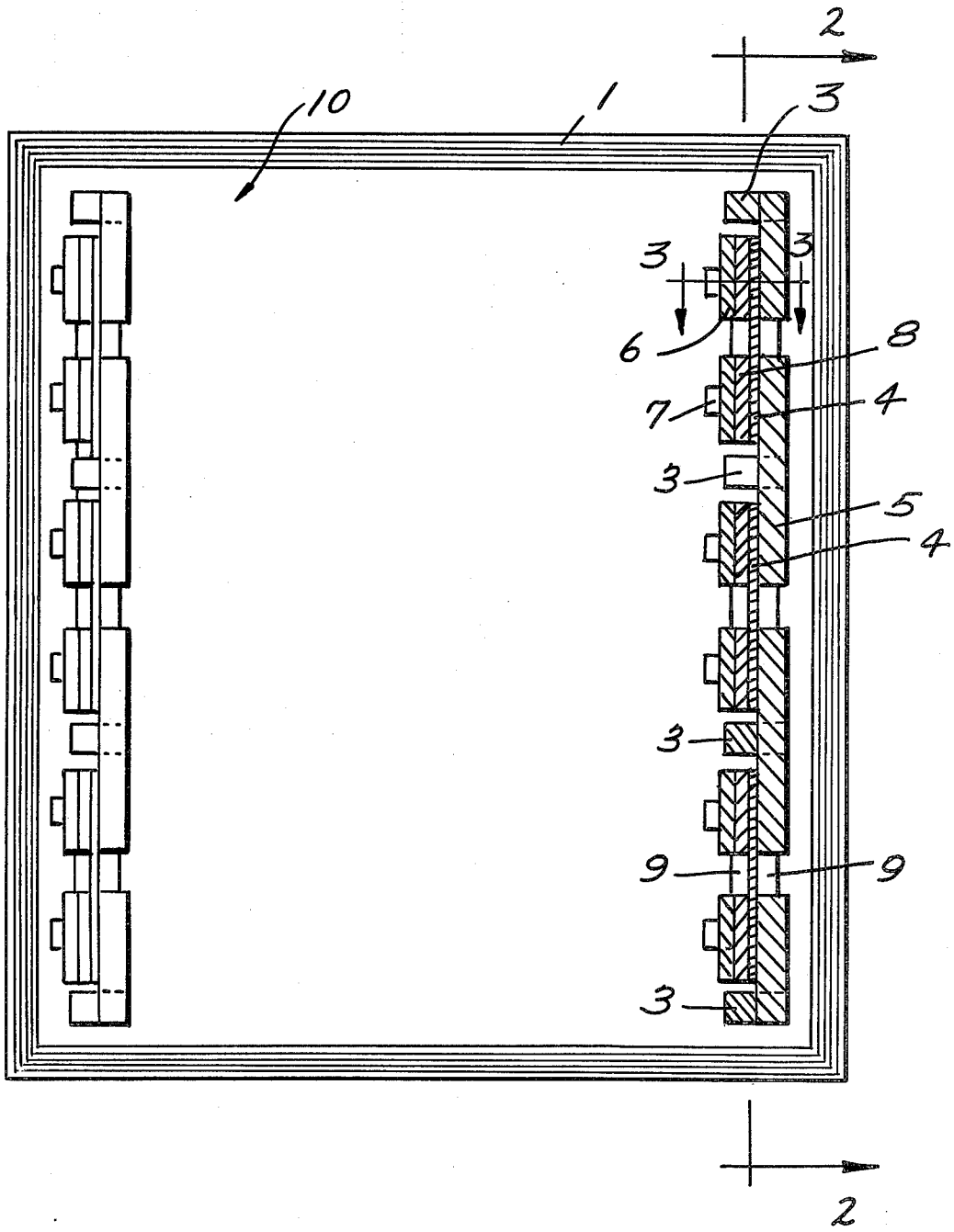
FIG. 1 is a cross-section through the heating chamber of a vacuum furnace having bottom and radiant heating both of which are carried out together.
Figure 2:
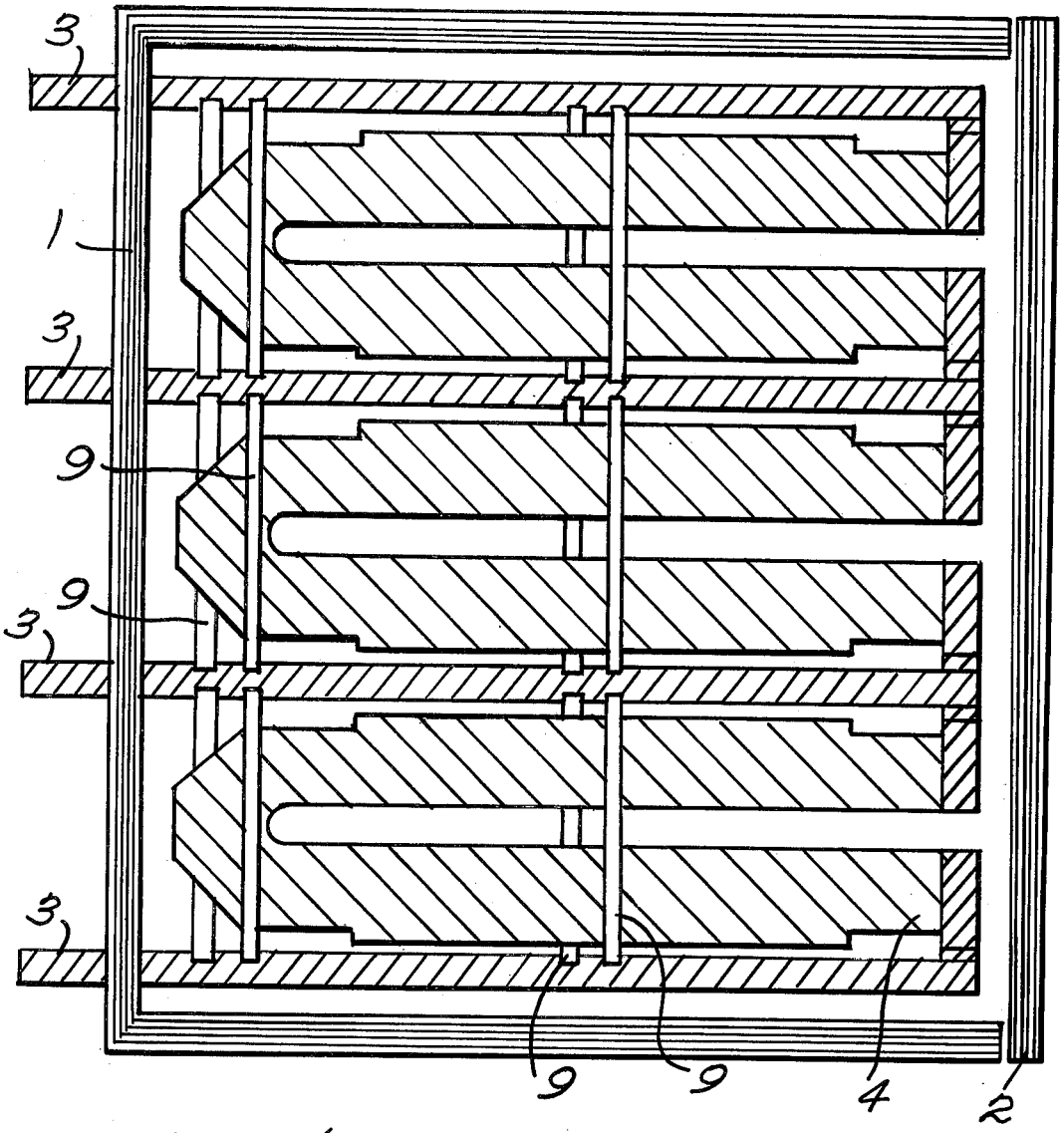
FIG. 2 is a sectional view along the line 2—2 of FIG. 1.
Figure 3:
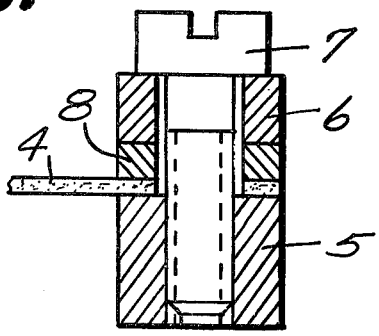
FIG. 3 is a sectional view along the line 3—3 of FIG. 1.

Referring more specifically to the drawings wherein like numbers refer to like parts, FIG. 1 shows a vacuum furnace with bottom and radiant heating. The insulation 1, generally consisting of graphite felt, encloses the heating chamber 10. FIG. 2 in plan view shows the bottom heating. The heating connection is located near the insulation door 2. The current feed takes place via graphite bars 3. The heating elements 4 of flexible graphite sheets are cut out in a U-shaped pattern so that the current path amounts to two furnace lengths. The passage of current from the solid graphite to the heating elements 4 can be seen from FIG. 3. The heating element 4 is pressed on a graphite piece 5 by means of a graphite bolt 7 and a graphite sheet 6 which in turn is firmly bolted to with the current supply bars 3. A graphite felt piece 8 between the two graphite parts 5 and 6 makes the bolting flexible and elastic. It has been proven that such an elastic pressing of the sheet heating elements is advantageous since otherwise the bolts 7 can be easily torn away because of different expansions with changes in temperature.

It can be further seen from FIG. 2 that the sheet elements 4 rest on aluminum oxide tubes 9 and are secured against tilting upwards by the same tubes 9.

It can be recognized from FIG. 2 that the heating elements 4 in front of the connections and at the rear wall advantageously have smaller widths. To reduce the cross-section the resistance is changed locally and therewith the output adjusts local requirements.

These changes in cross-section can also easily take place between two heating periods since the elements are quickly dismountable and easy to cut, even if they were already in operation.

What is claimed is:

1. In a vacuum furnace provided with graphite heating means and consisting essentially of the furnace body and heating means the improvement comprising said heating means comprising flexible thin graphite solid sheets having a thickness of 0.5–3 mm.

2. A vacuum furnace according to claim 1 wherein there is provided means for carrying an electric current to said graphite sheets and there are provided between said electric current carrying means and said graphite sheets connecting means including an elastically formed graphite felt.

3. A vacuum furnace according to claim 2 wherein said graphite sheets are cut in a U-shaped pattern.

4. A vacuum furnace according to claim 3 wherein the graphite sheets are of lesser width before the connecting means and the rear wall of the furnace than in the main portion of the sheets therebetween.

5. A vacuum furnace according to claim 1 wherein the graphite sheets are cut in a U-shaped pattern.

6. A vacuum furnace according to claim 5 wherein the sheets have a thickness of about 1.5–2 mm.

* * * * *